US006210845B1

(12) United States Patent
Hotta et al.

(10) Patent No.: US 6,210,845 B1
(45) Date of Patent: Apr. 3, 2001

(54) PLATE PRECURSOR FOR LITHOGRAPHIC PRINTING PLATE, METHOD FOR MAKING LITHOGRAPHIC PRINTING PLATE USING THE SAME, AND METHOD FOR PRODUCING THE PLATE PRECURSOR FOR LITHOGRAPHIC PRINTING PLATE

(75) Inventors: Yoshinori Hotta; Tadabumi Tomita, both of Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/313,369

(22) Filed: May 18, 1999

(30) Foreign Application Priority Data

May 18, 1998 (JP) ..... 10-135306
Apr. 6, 1999 (JP) ..... 11-099022

(51) Int. Cl.[7] ..... G03C 11/00

(52) U.S. Cl. ..... 430/19; 430/303; 430/270.1; 101/456; 101/467

(58) Field of Search ..... 430/270.1, 303, 430/19; 101/456, 457, 463.1, 467

(56) References Cited

U.S. PATENT DOCUMENTS

| | | | |
|---|---|---|---|
| 4,082,040 | 4/1978 | Yamashina et al. | 101/456 |
| 5,293,817 | 3/1994 | Nüssel et al. | 101/148 |
| 5,698,369 * | 12/1997 | Kawamura et al. | 430/281.1 |

FOREIGN PATENT DOCUMENTS

| | | |
|---|---|---|
| 0 545 468 | 6/1993 | (EP) . |
| 0 769 372 | 4/1997 | (EP) . |

* cited by examiner

*Primary Examiner*—Janet Baxter
*Assistant Examiner*—Barbara Gilmore
(74) *Attorney, Agent, or Firm*—Burns, Doane, Swecker & Mathis, LLP

(57) ABSTRACT

A plate precursor for a lithographic printing plate requiring no development, which comprises a surface formed of a solid material of an inorganic compound comprising at least two kinds of elements selected from groups 13, 14 and 15 of the periodic table; a method for making a lithographic printing plate using the same; and a novel plate precursor for a lithographic printing plate in which an image can be formed and deleted.

9 Claims, 3 Drawing Sheets

PLATE PRECURSOR FOR LITHOGRAPHIC PRINTING PLATE, METHOD FOR MAKING LITHOGRAPHIC PRINTING PLATE USING THE SAME, AND METHOD FOR PRODUCING THE PLATE PRECURSOR FOR LITHOGRAPHIC PRINTING PLATE

FIELD OF THE INVENTION

The present invention relates to a general light printing field, and particularly to lithography. Especially, the present invention relates to a novel plate precursor for a lithographic printing plate, an easy and simple offset printing method comprising employing a lithographic printing plate using the same, and a method for producing (reproducing) a plate precursor for a lithographic printing plate from the lithographic printing plate. More specifically, the present invention relates to a novel plate precursor for a lithographic printing plate requiring no development after imagewise exposure, and a method for making a lithographic printing plate using the same. Further, the present invention relates to a novel plate precursor for a lithographic printing plate in which an image can be easily formed and deleted by exposure to laser beams having different wavelengths and can be used in lithography after exposure as such because of no necessity of development, a method for making a lithographic printing plate using the same, and a method for producing (reproducing) a plate precursor for a lithographic printing plate.

BACKGROUND OF THE INVENTION

The technique of lithography is based on immiscibility of oil and water. Oil materials or ink is preferentially retained in image regions, and aqueous solutions are selectively retained in non-image regions. When surfaces of plate materials suitably prepared are wetted with water, followed by coating with print ink, the non-image regions hold water to repel the ink, whereas the image regions receive the ink to repel water. Accordingly, when these plate materials are brought into contact with surfaces to be printed, directly or indirectly through intermediates called blankets, the ink on the image regions is transferred to perform printing.

As materials for forming the ink-receiving image regions, many organic materials are known. They are basically formed from light-sensitive components (radiant ray-sensitive materials) and binders. As the radiant ray-sensitive materials, many materials are known. Useful negative type compositions include diazo resins, photo-crosslinkable polymers and photo-polymerizable compositions. Useful positive type compositions include aromatic diazo-oxide compounds such as benzoquinonediazides and naphthoquinonediazides. When imagewise exposure is given to these materials, followed by development and optional fixing, image regions of imagewise distribution are formed which can be used in printing.

As a material for forming the water holding non-image regions, an anodized aluminum surface has generally been used. For preparing aluminum for this application, both the graining process and the subsequent anodization are generally performed. The graining process is useful to improve the adhesion of the radiant ray-sensitive paint films, and also useful to enhance the water holding characteristics of the non-image regions of lithographic printing plates.

Such hydrophilized surfaces are exposed at non-image areas by exposure and development, and when fountain solutions are given thereto, they are sufficiently retained. Accordingly, the print ink is effectively repelled to inhibit stains in printing.

The above-mentioned ordinary lithographic printing plates are required to be developed with developing solutions after imagewise exposure. The developing solutions remove the non-image regions of image forming layers to expose the surfaces of supports hydrophilized by roughening thereof. The developing solutions are typical aqueous alkaline solutions, and sometimes contain organic solvents in large amounts. The development therefore requires not only its complicated processing procedure, but also waste disposal of large amounts of the aqueous alkaline solutions. Accordingly, this has been an important concern in the printing field for a long period of time. In recent years, the problem of the alkaline developing waste liquid has been noted particularly from the standpoint of environmental preservation, and methods for reducing the amount of waste liquid as small as possible and measures for lowering alkalinity have been proposed. However, no fundamental solution has been found.

From the above-mentioned background, efforts to produce printing plates requiring no development using alkaline developing solutions have been made. In recent years, for example, methods for preparing printing plates by use of laser exposure have been known. However, printing materials used herein mostly form images by ablation.

On the other hand, JP-A-9-169098 (the term "JP-A" as used herein means an "unexamined published Japanese patent application) proposes a method of using a $ZrO_2$ ceramic material as a surface material, and changing the surface properties by laser irradiation to form an image. In this system, the ceramic material itself has sensitivity to laser beams, and corresponds to image formation (ink-receptive) and deletion (hydrophilization) at different wavelengths. Accordingly, both the image formation and deletion can be carried out only by irradiation of laser beams.

However, for the lithographic printing plates requiring no development processing which have hitherto been proposed, sufficiently satisfactory practicability has not been obtained. That is to say, in a field to which a printing system is applied, extreme accuracy is generally required for maintaining the quality of images. Accordingly, the use of printing materials which form images by ablation undesirably causes mist produced by the ablation to become a source of pollution in the system.

Further, the printing material using the $ZrO_2$ ceramic material described in JP-A-9-169098 is very low in the degree of changes in polarity. Hence, when the surface is contaminated by some chance, there is the high possibility that ink adheres to a non-image area in printing practice to form a stain.

SUMMARY OF THE INVENTION

That is to say, an object of the present invention is to provide a novel plate precursor for a lithographic printing plate requiring no development with an alkaline developing solution after imagewise exposure, for solving many limitations and disadvantages of the above-mentioned prior art.

Another object of the present invention is to provide a method for making a lithographic printing plate using the same.

Still another object of the present invention is to provide a novel plate precursor for a lithographic printing plate in which an image can be formed and deleted by exposure to laser beams having different wavelengths, and in which the degree of changes in polarity before and after image formation can be made similar to that of a presensitized plate.

A further object of the present invention is to provide a method for making a lithographic printing plate using the same.

A still further object of the present invention is to provide a method for producing (reproducing) a plate precursor for a lithographic printing plate.

To the above-mentioned objects, the present inventors have discovered that a surface formed of a solid material of an inorganic compound (hereinafter also referred to as a ceramic material) comprising at least two kinds of elements selected from the group consisting of the group 13, 14 and 15 elements varies in the degree of hydrophilicity/ink-receptivity on receiving irradiation of active light, and based on this discovery, have further studied, thus completing the present invention. The present inventors have further discovered that, of the above-mentioned inorganic compounds, $Si_3N_4$ can delete an image by exposing it to a laser beam having a wavelength different from that of a laser beam used for image formation, thus completing the present invention. That is to say, the present invention is as follows:

(1) A plate precursor for a lithographic printing plate comprising a surface formed of a solid material of an inorganic compound comprising at least two kinds of elements selected from the group consisting of the group 13, 14 and 15 elements;

(2) The plate precursor for a lithographic printing plate described in the above (1), wherein the above-mentioned inorganic compound is $Si_3N_4$;

(3) The plate precursor for a lithographic printing plate described in the above (1) or (2), which comprises a support having thereon a layer formed of the solid material of the above-mentioned inorganic compound;

(4) A method for making a lithographic printing plate, which comprises making a non-image region hydrophilic and an image region ink-receptive by imagewise exposure of the plate precursor for the lithographic printing plate described in any one of the above (1) to (3) to active light, and then, bringing print ink into contact therewith to form a printed surface in which the image region has received the print ink;

(5) A method for making a lithographic printing plate, which comprises forming an image by irradiating the plate precursor for a lithographic printing plate described in the above (2) with a laser beam having a wavelength of 800 to 1,200 nm, and then, erasing the image by irradiating it with a laser beam having a wavelength of 10 to 20 $\mu$m; and (6) A method for producing a plate precursor for a lithographic printing plate, which comprises forming an image by irradiating the plate precursor for a lithographic printing plate described in the above (2) with a laser beam having a wavelength of 800 to 1,200 nm, and then, after termination of printing, exposing the whole surface of the lithographic printing plate to a laser beam having a wavelength of 10 to 20 $\mu$m.

Some of the elements belonging to the groups 13, 14 and 15 in the periodic table combine with each other to form a solid material of an inorganic compound. The present invention is based on the discovery of the noteworthy characteristic that a surface of this kind of solid material varies in the degree of hydrophilicity/ink-receptivity on receiving irradiation of active light. Accordingly, the above (1) makes clear that the irradiation of active light on the surface of this kind of solid material forms the basis of the present invention.

This kind of solid material may form either a single sheet or a layer structure laminated with another constituent layer, as long as it has an exposure surface which brings about changes in its properties.

The plate precursor for a lithographic printing plate of the above (1) is extremely large in changes in polarity due to the irradiation of active light, and can also provide the lithographic printing plate little stained in printing practice.

The compounds each comprising at least two kinds of elements belonging to the groups 13, 14 and 15 in the periodic table, which have the surface properties that the degree of hydrophilicity/ink-receptivity varies by the irradiation of active light and can be used in the present invention, include boron nitride (BN).

Further, the compound represented by $Si_3N_4$ is also a compound having the above-mentioned surface properties which can be used in the present invention. Of course, a mixture of the compounds shown herein, that is to say, BN+$Si_3N_4$, can also be used in the present invention.

The above (2) describes that the plate precursor for a lithographic printing plate can be obtained in which an image can be directly formed and deleted by irradiation of laser beams by the use of $Si_3N_4$ as the solid material of the above-mentioned inorganic compound.

The above (3) describes that the plate precursor for a lithographic printing plate in which a layer formed of this kind of solid compound comprising at least two kinds of elements selected from the group consisting of the group 13, 14 and 15 elements is carried on a support is a preferred embodiment of the present invention. In this case, the support may be either a metallic support such as an aluminum plate or a flexible support such as a plastic sheet.

As described in the above (4), the method for making the lithographic printing plate of the present invention is a method for making a lithographic printing plate which has received print ink in an image form so that a non-image region is hydrophilic and an image region is ink-receptive by the imagewise irradiation of active light on the surface of the solid material of the above-mentioned inorganic compound. In this case, there are compounds in which surfaces of the solid materials are changed from hydrophilic to hydrophobic, for example, boron carbide, and compounds in which surfaces of the solid materials are changed from hydrophobic to hydrophilic, for example, boron nitride, aluminum nitride and silicon nitride ($Si_3N_4$). In the present invention, both of them can be utilized.

Further, the active light which can change the polarity is preferably a radiation having the property of converting radiant energy to thermal energy, and particularly, infrared rays having a wavelength of 0.7 $\mu$m to 30 $\mu$m, from the near infrared region to the infrared region, are suitable.

As described in the above (5) and (6), the image formation and deletion become possible by the irradiation of the solid $Si_3N_4$ material with laser beams having different wavelengths, and a repeatedly available system can be obtained. Specifically, the laser beam used for the image formation has a wavelength within the region from 800 to 1,200 nm, and the laser used for the image deletion has a wavelength within the region from 10 to 20 $\mu$m.

The method of the present invention has many advantages, compared with conventional known lithographic printing methods. Examples of such advantages include no requirement of chemical treatment for printing plates, the solution of complicated work associated with the use of aqueous alkaline developing solutions, low cost caused by that when $Si_3N_4$ is used as the above-mentioned solid material, an image can be formed and deleted by the irradiation of laser beams having different wavelengths, which makes it possible to reproduce the plate precursor for a lithographic printing plate, and the prevention of environmental pollution. Further, post exposure baking of blanket exposure to ultraviolet rays or visible light sources are also not required.

The imagewise irradiation to the printing plates can be conducted by focusing laser beams which can convert the surfaces of the inorganic solid compounds from the hydrophilic state to the ink-receptive state, or from the ink-receptive state to the hydrophilic state. The irradiation using these focusing laser beams also makes it possible to prepare printing plates directly from digital data without requiring conventional block copy procedures which have been generally performed through photographic films. This is an advantage of the printing method of the present invention.

Further, several processes associated with plate making processing such as chemical treatment, wiping, brushing and baking also become unnecessary. Accordingly, for the further simplification of the printing processes utilizing the present invention, it also becomes possible to directly exposing printing plates on printing machines by equipping the printing machines with laser exposure devices and suitable means for adjusting the positions of the laser exposure devices. The surfaces of the inorganic solid compounds used in the present invention are well compatible with the functions of usual fountain solutions and ink for lithography, so that novel or expensive chemical compositions are not required.

The solid materials of the inorganic compounds used in the present invention have many characteristics in respect to the use of lithography and printability, as well as the advantages in terms of workability and environmental safety. For example, the material surfaces are high in hardness as a characteristic of ceramic materials, so that they are excellent in durability and wear resistance. They therefore last long. Further, the inorganic solid materials are used as high strength materials, and themselves have sufficient strength as rotary printing plates such as plate cylinders. Furthermore, when $Si_3N_4$ is used as the above-mentioned solid material, it can be repeatedly available. Accordingly, when it is utilized as plate cylinders of printing machines, a system which can also correspond to correction on the plate cylinders can be proposed. On the other hand, the production work of the printing plates and the cost are saved, so that they are also suitable for the use in printing of a small number of sheets. Further, the ink-receptive image regions are excellently distinguished from the hydrophilic image regions, so that the quality of print-finished images is also at a high level. In addition, printing surfaces can be formed in a rigid, semi-rigid or soft form as so desired. Further, image forming process conducted only by the irradiation of active light is rapid and easy, and the resolution of the resulting images is also high depending on the irradiation beam. Accordingly, the lithographic printing techniques of the present invention is particularly advantageous to the application to images electronically captured and digitally stored.

The plate precursors for lithographic printing plates used in the present invention show excellent long-term durability, exceeding that of the conventional grained and anodized aluminum plates produced as described above. Further, the plates of the present invention are much simpler and less expensive than the conventional lithographic printing plates requiring no fountain solutions, based on the use of silicone rubber, and provide longer-term continuous printing than that attained by such lithographic printing plates requiring no fountain solutions.

The solid materials of the inorganic compounds used in the present invention include well-known commercial materials, and have many applications such as semiconductors. However, the application of these materials to improvements in the lithographic printing processes has not hitherto been disclosed, and similarly, the use of $Si_3N_4$ as the material on which an image can be directly formed and deleted with laser beams has not disclosed at all. That is to say, the present invention is considered to bring about a great advance in the technical field of lithography.

DETAILED DESCRIPTION OF THE INVENTION

Figure 1:
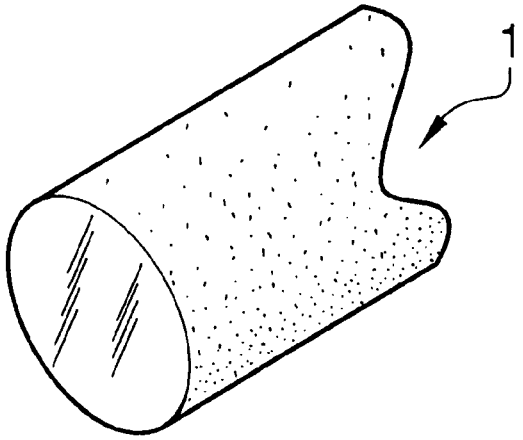
FIG. 1 is a perspective view showing an example of a plate precursor for a lithographic printing plate of the present invention the whole of which is formed of a solid material of an inorganic compound (a ceramic material)

Specific embodiments of the practice of the present invention will be described below.

The solid materials of the inorganic compounds used in the present invention are materials containing at least compounds each comprising at least two kinds of elements belonging to the groups 13, 14 and 15 in the periodic table. Preferably, 50% or more of each material is the above-mentioned compound, and more preferably, each plate material is composed of the above-mentioned compound alone. Preferred examples of the compounds are compounds each comprising at least two elements selected from the group consisting of boron, aluminum, gallium, indium, carbon, silicon, germanium, tin, nitrogen, arsenic, antimony and bismuth, and more preferably, compounds each comprising at least two elements selected from the group consisting of boron, aluminum, carbon, silicon, tin, nitrogen, antimony and bismuth. Particularly preferred examples thereof are boron nitride, aluminum nitride, silicon nitride, boron carbide, boron nitride-aluminum nitride mixtures and boron nitride-silicon nitride mixtures among others.

When the solid material is also allowed to correspond to the image deletion as described above, $Si_3N_4$ is selected.

As described above, the solid materials of the inorganic compounds used in the present invention can efficiently be converted form the hydrophilic state to the ink-receptive state, or from the ink-receptive state to the hydrophilic state by the irradiation of active light having a near infrared to infrared wavelength. The active light having this wavelength is converted to thermal energy when absorbed by the surfaces of the solids materials of the inorganic compounds according to the present invention to elevate the temperature of the surfaces, thereby changing the polarity of the surfaces. For the light-heat conversion, a Nd:YAG laser having a wavelength of 1064 nm is preferred. In particular, a Nd:YAG laser equipped with a Q switch, in which pumping is optically carried out with a krypton arc lamp by pulse oscillation is preferred.

When $Si_3N_4$ is used as the solid material of the inorganic compound for the image formation and deletion, the laser beam used for the image formation has a wavelength within the region from 800 to 1,200 nm, and the laser used for the image deletion has a wavelength within the region from 10 to 20 $\mu$m. At this time, the laser used for the image formation is preferably the above-mentioned Nd:YAG laser having a wavelength of 1064 nm, and similarly, a system is preferred which is equipped with a Q switch, in which pumping is optically carried out with a krypton arc lamp by pulse oscillation, and which can give pulses of high energy for a short period of time.

When images are formed on the surfaces of the solid materials of the inorganic compounds used in the present invention, laser beams having a peak output of 1000 W, preferably 2000 W is preferably irradiated.

Although the preferred intensity of irradiation light varies according to the properties of image forming layers of the inorganic solid compounds, and also depending on the target level of the image/non-image identification because the contact angle decreased with the quantity of irradiation light, the surface exposure intensity before modulation with images for printing is usually from 0.05 to 100 joules/cm$^2$, preferably from 0.2 to 10 joules/cm$^2$, and more preferably from 0.5 to 5 joules/cm$^2$.

When $Si_3N_4$ is used, the surface exposure intensity is more preferably from 1 to 5 joules/cm$^2$. Areas irradiated with the laser beam become black, and image areas can be observed with the naked eye. Of the lasers used for the image deletion, a $CO_2$ laser emitting a beam having a wavelength of 10.6 $\mu$m is particularly preferred. When the areas which have irradiated with a beam emitted from the above-mentioned YAG laser to become black are irradiated with this $CO_2$ laser beam, those areas are faded. It can be therefore observed with the naked eye that the images are deleted, as with the image formation. Of course, even if areas which have not been irradiated with the YAG laser beam are irradiated with the $CO_2$ laser beam, no change occurs. The areas thus deleted by the $CO_2$ laser beam irradiation can be made ink-receptive, which is the same as with the untreated areas.

When the laser exposure is conducted for the purpose of erasing images, there are a method of allowing a laser beam to scan imagewise by digital data and a method of allowing the laser beam to scan the whole surface to conduct exposure.

For the production of the solid materials of the inorganic compounds used in the present invention and the layers thereof, known materials and methods can be used. When the solid materials of the inorganic compounds are produced, they are generally formed as sintered bodies.

For example, when $Si_3N_4$ is formed as a sintered body, a surface thereof is ink-receptive. However, when sintering is insufficient, or when a solid is obtained by a reaction sintering method, the solid has a very porous structure. In some cases, therefore, water is absorbed from the surfaces because of its voids. Such a surface is of course unsuitable for the present invention. However, the sintered body having a density of 2.0 g/cm$^3$ or more, preferably about 2.7 to about 3.0 g/cm$^3$ obtained by an atmospheric pressure sintering method does not show such behavior, and is sufficient for the use of the present invention. More preferably, the sintered body is prepared by a method such as pressurized sintering used for enhancing the strength. In this case, the sintered body has a density of 3.2 g/cm$^3$ or more, a strength of about 100 kg/mm$^2$ and a fracture toughness $K_{IC}$ of about 7 MPa/m$^2$, and has the sufficient strength even when it is formed as a rotor described later.

When the solid materials of the inorganic compounds used in the present invention are produced by sintering, sintering assistants are used for enhancing sintering properties. For example, $Si_3N_4$ is difficult to be sintered, because it is a nitride. Accordingly, a method is employed in which the sintering assistant such as $Y_2O_3$, $Al_2O_3$ or MgO is mixed therewith to allow a sintering reaction to proceed at a relatively low temperature, thereby obtaining a dense sintered body having small voids. The above-mentioned $Y_2O_3$, $Al_2O_3$ and MgO are typical sintering assistants for $Si_3N_4$. Even if they are contained in an amount of 20% by weight or less, the behavior of the image formation and deletion with the laser beams itself does not change. However, when they are contained in an amount of more than that, the behavior of a sintering assistant component appears in parallel in addition to the original behavior of $Si_3N_4$, resulting in failure to obtain sufficient changes in polarity, particularly, with respect to the image deletion.

From the above-mentioned reasons, when the solid material of the inorganic compound is $Si_3N_4$, it is preferred that the sintered body contains 80% by weight or more of $Si_3N_4$.

Figure 2:
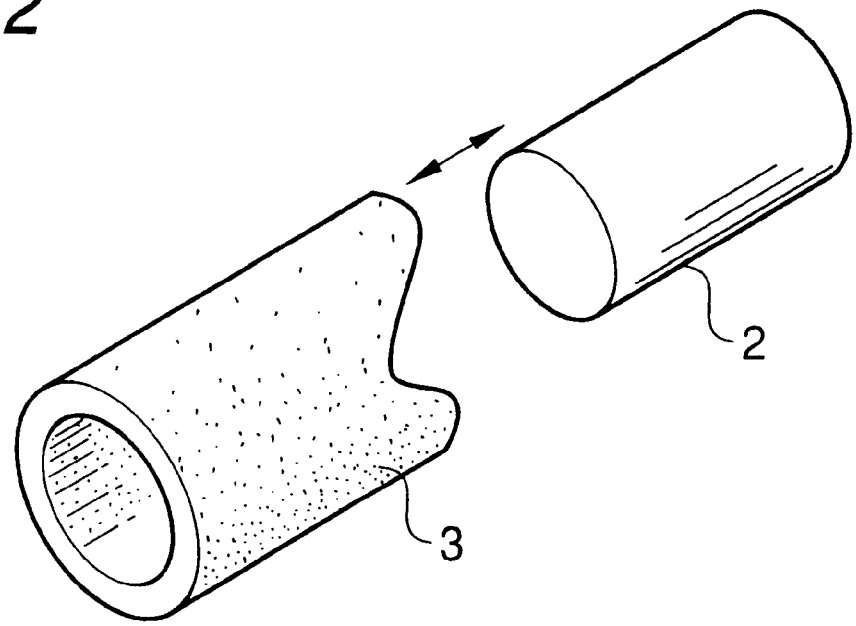
FIG. 2 is a perspective view showing an example of an sleeve-shaped plate precursor for a lithographic printing plate of the present invention which is formed of a solid material of an inorganic compound (a ceramic material) and can be put on and taken off from a plate cylinder.

When the solid material of the inorganic compound formed as a sintered body is used, it may be formed in a tubular shape for using it in easy and simple printing, to a rotor 1 such as a plate cylinder used in an ordinary offset printing machine as shown in FIG. 1, or to a sleeve 3 (cylindrical one) which can be put on and taken off from a conventional plate cylinder 2 as shown in FIG. 2.

Further, when handling based on the conventional printing plates is required, it is preferred that the compound layers are formed on supports. Coatings of these inorganic compounds can be relatively simply formed on the supports, using thermal spraying, CVD and sputtering. It is of course possible to adhere sheets of ceramic mixtures called "green sheets" in this industry to bases, followed by sintering.

Figure 3:
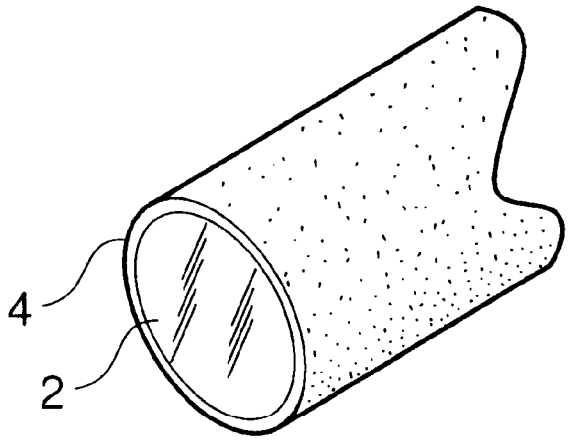
FIG. 3 is a perspective view showing an example of a plate precursor for a lithographic printing plate of the present invention having a solid layer of an inorganic compound on a surface of a plate cylinder.
Figure 4:
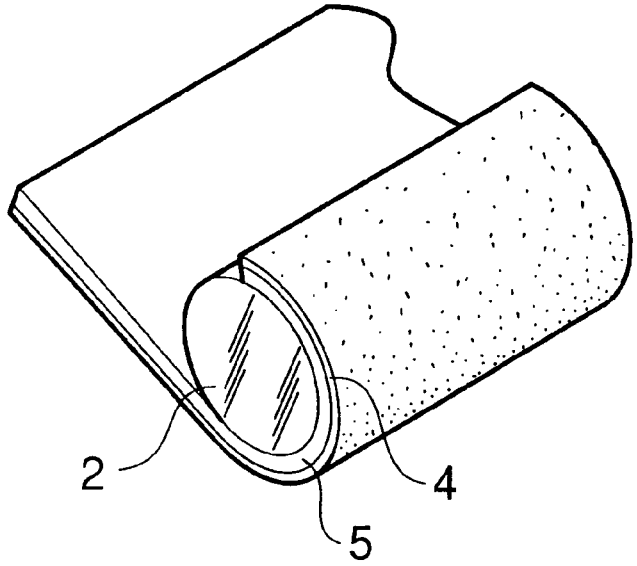
FIG. 4 is a perspective view showing an example of a form in which a plate precursor for a lithographic printing plate of the present invention provided with a ceramic layer on a surface of a support is wrapped around a plate cylinder.

For the printing plates according to the present invention, various materials can be used in various forms. For example, a solid layer 4 of the inorganic compound is formed on a surface of a plate cylinder 2 of a printing machine by vapor deposition, immersion or coating according to the above-mentioned method to directly provide the solid layer of the inorganic compound as shown in FIG. 3, or a surface of a support 5 is provided with a solid layer 4 of the inorganic compound, and wrapped around a plate cylinder 2 to form a printing plate as shown in FIG. 4. Preferred examples of the supports 5 include aluminum, stainless steel, nickel and copper plates. Further, flexible metal plates can also be used. Flexible plastic supports such as those of polyesters and cellulose esters can also be used. The inorganic compound layers may be formed on supports such as water-proofing paper, polyethylene-laminated paper and impregnated paper, and the resulting products may be used as printing plates.

The solid compound layers formed on the supports have a thickness ranging from 0.02 to 5 mm, and more preferably from 0.1 to 0.3 mm.

The supports used are dimensionally stable tabular materials, and include, for example, metal supports (such as supports composed of stainless steel, nickel, brass, aluminum, or other metals or alloys), paper, paper laminated with plastics (such as polyethylene, polypropylene and polystyrene), metal plates (such as aluminum, zinc, copper and stainless steel plates), plastic films (such as cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonates and polyvinyl acetal), or paper or plastic films laminated or deposited with the above-mentioned metals.

The supports are preferably polyester films, aluminum plates or SUS plates which are difficult to corrode on the printing plates. Of these, the aluminum plates which are good in dimensional stability and relatively inexpensive are particularly preferred. Preferred examples of the aluminum plates include a pure aluminum plate and alloy plates mainly composed of aluminum and containing different elements in slight amounts. Further, plastic films laminated or deposited with aluminum may be used. Examples of the different elements contained in the aluminum alloys include silicon, iron, manganese, copper, magnesium, chromium, zinc, bismuth, nickel and titanium. The content of the different elements in the alloys is at most 10% by weight or less. Although aluminum particularly suitable in the present invention is pure aluminum, it is difficult in respect to refining technology to produce completely pure aluminum. Accordingly, aluminum may slightly contain foreign elements. Like this, the aluminum plates applied to the present invention are not specified in their composition, and the aluminum plates of conventional raw materials well known in the art can be appropriately utilized. The thickness of the supports used in the present invention is from about 0.1 mm to about 0.6 mm, preferably from 0.15 mm to 0.4 mm, and particularly preferably from 0.2 mm to 0.3 mm.

When the aluminum plates are used as the supports, known surface roughening treatment may be applied to the surfaces thereof.

However, when the inorganic compound layers are provided on the supports by methods such as thermal spraying and vapor deposition as described above, it is necessary to select the supports, considering that the temperature of the supports are also elevated.

"The change between the ink-receptivity and the hydrophilicity caused by the irradiation of active light" which is fundamental in the present invention is very significant. A larger difference between the hydrophilicity and the ink-receptivity of the image areas and the non-image areas results in a remarkable identifying effect and clear printed surfaces. At the same time, the press life is also increased. The difference between the hydrophilicity and the ink-receptivity can be represented by the contact angle to a drop of water. The higher hydrophilicity results in a wider spread of a drop of water, which reduces the contact angle. Conversely, when a drop of water is repelled (water repellency, namely ink-receptivity), the contact angle increases. Accordingly, plate precursors having the surface layers of the inorganic solid compounds of the present invention are abruptly changed in the contact angle in areas irradiated with active light to form ink holding areas and water holding areas imagewise on the plate surfaces, and brought into contact with receiving sheets such as paper, thereby transferring ink onto surfaces to be printed.

The degree of changes in polarity of zirconia ($ZrO_2$) described in JP-A-9-169098 given above as the prior art is insufficient. In contrast, the changes in polarity of the surfaces formed of the compounds of the present invention are very large, so that it is possible to obtain the surfaces having the sufficient water holding property in the non-image areas, selecting system of compounds and active light.

After image printing exposure to the surface layers of the inorganic solid compounds, the printing plate precursors can be sent to the lithographic printing step as such without development processing.

Accordingly, the present invention has many advantages including simplicity, compared with known lithographic printing methods. That is to say, as described above, the chemical processing using alkaline developing solutions is not required, wiping and brushing associated therewith are also unnecessary, and environmental pollution caused by discharge of development waste liquid is not accompanied.

The exposed areas of the lithographic printing plates obtained as described above are sufficiently hydrophilized, so that additional procedures for enhancing identification between the hydrophilicity and the ink-receptivity which have hitherto been conducted are not required. However, after treatment may be conducted with washing water, surfactant-containing rinsing solutions and desensitizing solutions containing gum arabic and starch derivatives, if necessary.

Methods applied include coating of the lithographic printing plates with the burning conditioners by use of sponge or absorbent cotton impregnated therewith or by immersing the printing plates in a vat filled with the burning conditioner, or coating by use of an automatic coater. Further, it gives a more preferred result that the amount thereof coated is made uniform with a squeegee or a squeegee roller after coating. The amount of the burning conditioner coated is generally suitably 0.03 to 0.8 $g/m^2$ (dry weight).

The lithographic printing plates obtained by such treatment are set on an offset printing machine, and used for printing of many sheets.

In addition, the surfaces of the plate precursors for printing plates according to the present invention may be either hydrophilic or conversely ink-receptive before the irradiation of active light, depending on the materials used. In the case of $Si_3N_4$, the surface is ink-receptive before the irradiation of active light.

Figure 5:
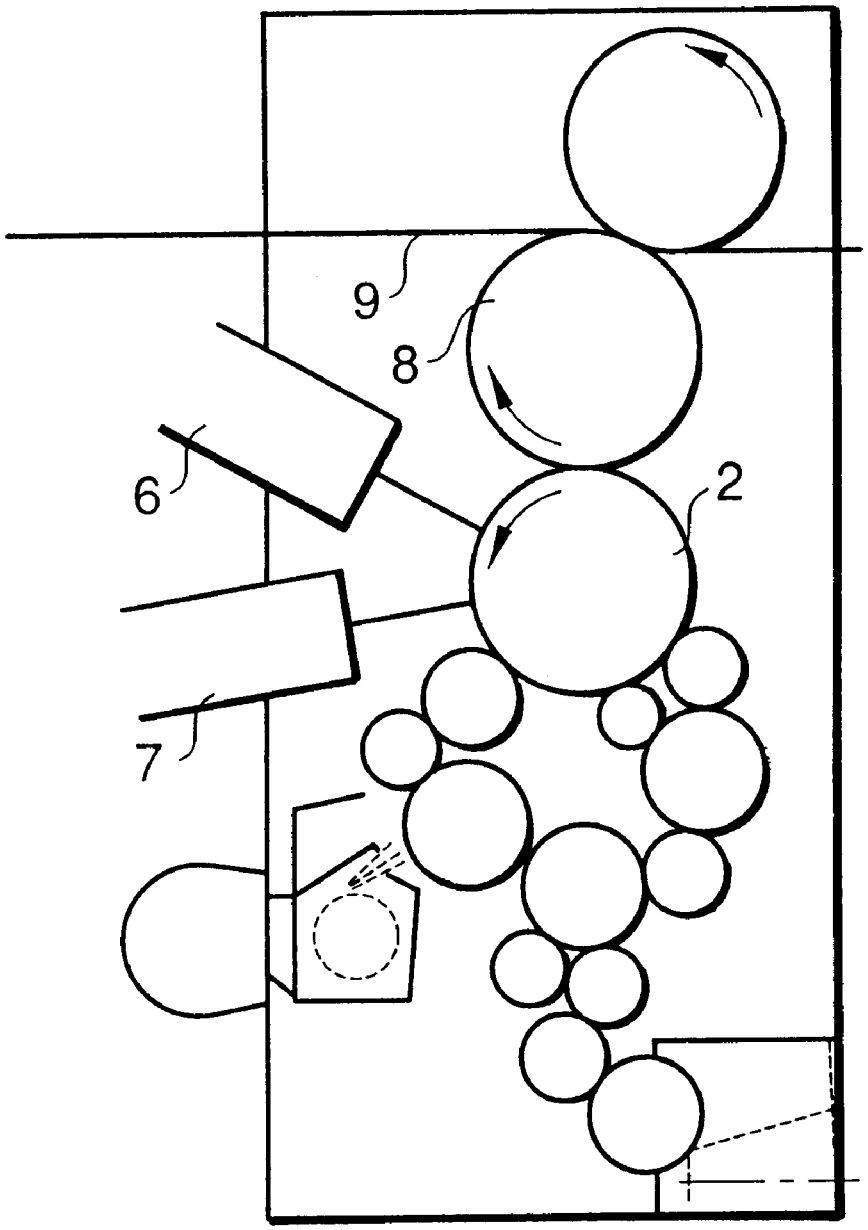
FIG. 5 is a schematic view showing a lithographic printing system according to the present invention, in which the image formation and deletion are possible.

The printing method according to the present invention is conducted using as a constituent a lithographic printing system comprising a laser beam source 6 which can form images on the surfaces of the printing plates, a control means (not shown in the drawing) for operating the laser, a means (not shown in the drawing) for supplying fountain solutions, a means (not shown in the drawing) for applying the fountain solutions to the printing surfaces, a means (not shown in the drawing) for supplying ink for lithography and a means (not shown in the drawing) for transferring the ink for lithography to the printing surfaces, as shown in FIG. 5, in addition to the use of the printing plates of the present invention.

Further, when $Si_3N_4$ is used as the solid material of the inorganic compound of the present invention to conduct the image deletion, a laser beam source 7 for deletion and a control means (not shown in the drawing) for operating the laser for deletion are further added to the lithographic printing system as shown in FIG. 5.

The use of the above-mentioned system transfers ink images given to the surfaces of the lithographic printing plate to matter 9 to be printed through a blanket cylinder 8, thereby obtaining printed matter.

The present invention will be described in respect to the following examples in greater detail.

EXAMPLE 1

Some of plates formed of solid materials of inorganic compounds of the present invention into a size of 100 mm×100 mm×5 mm (in thickness) were irradiated with a Nd:YAG laser beam. This Nd:YAG laser was equipped with a Q switch, and operated under a system in which pumping was optically carried out with a krypton arc lamp. The spot size thereof, namely the beam diameter, was about 100 μm.

| | | |
|---|---|---|
| Laser Beam Mode: | Single Mode (TEM00) | |
| Peak Output | 5200 W: | 1000–8000 W |
| Average Output | 10 W: | 10–20 W or more |
| Pulse Rate | 20 KHz: | 10–50 KHz |
| Pulse Duration | 0.1 μsec: | 0.1–0.2 μsec |
| Spot Diameter | 100 μm | |

The contact angle was measured using a contact-angle meter (Contact-Angle Meter Type CA-12, manufactured by Kyowa Kaimen Kagaku Co.). Deionized water (polar) was used for measurement, and the contact angle was measured for laser-irradiated areas and areas not irradiated. Results of comparison thereof are shown in Table 1.

TABLE 1

| Sample | Irradiated | Not Irradiated | Change in Contact Angle | Remarks |
|---|---|---|---|---|
| BN | 55 | 80 | 25 | Invention |
| BN—AlN | 0 | 60 | 60 | Invention |
| BN—$Si_3N_4$ | 0 | 75 | 75 | Invention |
| AlN | 25 | 85 | 60 | Invention |
| $Si_3N_4$ | 0 | 65 | 65 | Invention |
| $B_4C$ | 60 | 35 | −25 | Invention |
| $ZrO_2$ | 50 | 45 | −5 | Comparison |
| $Al_2O_3$ | 45 | 45 | 0 | Comparison |
| $Al_2O_3$—$SiO_2$ | 45 | 45 | 0 | Comparison |

As shown in Table 1, large changes in the contact angle could be obtained by the irradiation of the laser beam. That is to say, for the solid materials other than boron carbide, the contact angle decreased in the areas irradiated with the laser beam, whereas for boron carbide, the contact angle increased in the areas irradiated with the laser beam. In any event, it was indicated that the ink receptivity can be changed by the changes in the contact angle. It was therefore shown that print ink could be selectively adhered to the image regions. On the other hand, for the conventional known metal oxides shown in Comparative Examples, the changes in the contact angle by the irradiation of the laser beam were slight.

EXAMPLE 2

Each inorganic solid compound plate described in Example 1 was irradiated with a Nd:YAG laser modulated with a continuous tone image containing a halftone image to conduct image printing. Distilled water was applied onto an image-formed plate with a lint-free cotton pad, the black oil print ink was applied onto the plate with a hand roller. As a result, in all compounds, except boron carbide, the ink did not adhere to the laser-irradiated region, and selectively adhered only to the region not irradiated. For the boron carbide sample, conversely, the ink adhered to the laser-irradiated region, and did not adhered to the region not irradiated. Plain paper was placed on this plate, and pressure was applied to the paper. Thus, a clear transferred image could be obtained.

EXAMPLE 3 AND COMPARATIVE EXAMPLES 1 AND 2

An example in which $Si_3N_4$ was used as the solid material of the inorganic compound on which an image can be formed and deleted with laser beams is described in detail below.

A 100 mm×100 mm×5 mm thick plate formed of a sintered body of $Si_3N_4$ was prepared. This sintered body contained Y and Al as assistant elements, and had a density of 2.7 g/cm$^3$. As comparative examples, alumina and zirconia were each similarly sintered and formed to prepare plates. Details thereof are shown in Table 2.

TABLE 2

| | Material | Impurity (Assistant Component) | Density (Bulk Density) |
|---|---|---|---|
| Example 3 | $Si_3N_4$ | Al, Y, B, C | 2.7 |
| Comparative Example 1 | $ZrO_2$ | Y | 6.0 |
| Comparative Example 2 | $Al_2O_3$ | — | 3.3 |

Each of the tabular samples thus prepared was irradiated in the same manner as with Example 1 with the exception that the following laser irradiation conditions were used.

Laser Mode: Single Mode (TEM00)

Spot Diameter: about 100 μm

Average Output: 2 W (0.1–1.5 W)

Peak Output: 6000 W (300–6000 W)

Pulse Frequency: 2 kHz

Pulse Width: 0.12 μsec.

Scanning Speed: 50 mm/sec.

The irradiated area was irradiated with a $CO_2$ laser beam (wavelength: 10.6 μm) to delete an image. The $CO_2$ laser was of the continuous oscillation system, and the spot size thereof, namely the beam diameter thereof, was about 70 μm. Specific laser irradiation conditions are shown below:

Spot Diameter: about 70 μm

Average Output: 8.4 W (5–10 W)

Scanning Speed: 500 mm/sec.

The contact angle was measured using a contact-angle meter (Contact-Angle Meter Type CA-12, manufactured by Kyowa Kaimen Kagaku Co.). Deionized water (polarity) was used for measurement, and the respective contact angles were measured for Nd-YAG laser-irradiated areas, $CO_2$ laser-irradiated areas and areas not irradiated, and compared.

Changes in the appearance of the respective laser-irradiated areas were visually confirmed. The contact angles and changes in the appearance are shown in Table 3.

TABLE 3

| | | Area Not Irradiated | | YAG Laser | | | CO2 Irradiation | |
|---|---|---|---|---|---|---|---|---|
| Example No. | Material | Appearance | Contact Angle | Power | Appearance | Contact Angle | Appearance | Contact Angle |
| Example 3 | $Si_3N_4$ | gray | 58 | 0.5 | gray | 25 | — | — |
| | | | | 1.0 | black | 0 extended wetting | gray | 50 |
| | | | | 5.0 | black | 0 extended wetting | — | — |
| | | | | 10.0 | black | 0 extended wetting | gray | 52 |
| Comparative Example 1 | $ZrO_2$ | milky white | 49 | 10.0 | black | 57 | milky white | 44 |
| Comparative Example 2 | $Al_2O_3$ | milky white | 50 | 10.0 | milky white | 50 | milky white | 51 |

A ceramic surface of $Si_3N_4$ became hydrophilic by the YAG laser irradiation, and the areas irradiated with the YAG laser beam became ink-receptive again by the $CO_2$ laser irradiation. A lower output of the YAG laser showed a tendency to smaller changes in polarity.

The surface of $Si_3N_4$ was largely changed in polarity, and the color was also externally changed by the image formation and deletion. Accordingly, the image formation and deletion by exposure could be easily confirmed.

In contrast, a surface of alumina irradiated with the YAG laser beam showed no particular changes in appearance to a degree that the areas irradiated could not be confirmed, and no changes in polarity were also observed. A surface of zirconia irradiated with the same YAG laser beam was changed to black, and the change in color was large. However, the degree of changes in polarity was small, and this was inferior to Example 3 of the present invention.

EXAMPLE 4

Water was added to $Si_3N_4$ powder, a ceramic raw material, as a binder, and other assistants were appropriately added thereto. The resulting mixture was formed in the shape of a tablet having a diameter of 20 mm and a thickness of about 5 mm. This was sintered under atmospheric pressure at a temperature of 1600° C. to prepare a sample. For comparison, alumina ($Al_2O_3$) powder was formed and sintered by the same method to prepare a sample.

The properties of the sintered bodies thus obtained were as follows.

These samples were irradiated with the YAG laser beam and the $CO_2$ laser beam under the same conditions as with Example 3, and the appearance and changes in polarity were examined.

TABLE 4

| Main Component | Assistant Component | Amount Added | Area Not Irradiated Contact Angle | YAG Irradiation Contact Angle | $CO_2$ Irradiation Contact Angle | Remarks |
|---|---|---|---|---|---|---|
| $Si_3N_4$ | not added | — | 49 | 0 extended wetting | 43 | Invention |
| | $Al_2O_3$ | 10 | 44 | 0 extended wetting | 40 | Invention |
| | | 20 | 47 | 0 extended wetting | 41 | Invention |
| | | 40 | 43 | 0 extended wetting | 4 | Comparison |
| | $Y_2O_3$ | 10 | 46 | 0 extended wetting | 40 | Invention |
| | | 20 | 45 | 0 extended wetting | 45 | Invention |
| | | 40 | 42 | 0 extended wetting | 10 | Comparison |
| $Al_2O_3$ | not added | — | 47 | 47 | 45 | Comparison |

A surface of $Si_3N_4$ was largely changed in polarity, and the appearance was also changed so that the areas irradiated were clearly distinguished. However, when the assistant component exceeded 20% by weight based on the main component, the degree of changes in polarity (changes in the contact angle) was decreased, and particularly, the behavior of the image deletion by the $CO_2$ irradiation could not obtained. In contrast, a surface of alumina irradiated with the YAG laser beam showed no particular changes in appearance to a degree that the areas irradiated could not be confirmed, and no changes in polarity were also observed.

EXAMPLE 5

Using the plate precursor for a lithographic printing plate prepared in Example 3, a printing test was actually conducted for the areas irradiated with the YAG laser beam changing energy thereof and for the areas deleted with the $CO_2$ laser beam. After deionized water (polarity) was given to these areas on the material surface, ink (GEOS Chinese ink manufactured by Dainippon Ink & Chemicals, Inc.) was adhered thereto with an ink roller. As a result, areas to which ink adhered and areas to which ink did not adhere corresponding to hydrophilicity and ink-receptivity were clearly observed. The ink images on this surface were transferred to a blanket and further to paper, which allowed clear images to be printed.

Compared with the conventional lithographic printing techniques, the plate precursors for lithographic printing plates described in this specification have advantages that the printing plates can be directly obtained only by the irradiation of active light without procedures such as development, so that the plate-making processing process is simple and rapid, that the resulting printing plates are excellent in separation resistance, wear resistance and durability, and that no scattered matter is produced because no ablation is carried out, which causes no pollution of the working atmosphere. Further, memorably, the plate precursors for lithographic printing plates of the present invention are extremely high in the degree of changes in polarity before and after image formation, and can be sufficiently competent for the use as presensitized plates. Furthermore, the use of $Si_3N_4$ as the solid material of the inorganic compound in the present invention makes it possible to delete the images of the lithographic printing plates or to reproduce the plate precursors for lithographic printing plates, while having the above-mentioned advantages. Thus, the repeated use of the plates has first become practical.

What is claimed is:

1. A plate precursor for a lithographic printing plate consisting essentially of a surface formed of a solid material of an inorganic compound comprising at least two kinds of elements selected from groups 13, 14 and 15 of the period table wherein an image can be formed and deleted on the surface by exposure to laser beams having different wavelengths.

2. The plate precursor for a lithographic printing plate according to claim 1, which consists essentially of a support having thereon a layer formed of the solid material of said inorganic compound.

3. A plate precursor for a lithographic printing plate comprising a surface formed of a solid material of an inorganic compound wherein said inorganic compound is $Si_3N_4$.

4. The plate precursor for a lithographic printing plate according to claim 3, which comprises a support having thereon a layer formed of the solid material of said inorganic compound.

5. A method for making a lithographic printing plate, which comprises making a non-image region hydrophilic and an image region ink-receptive by imagewise exposure of a plate precursor for the lithographic printing plate comprising a surface formed of a solid material of an inorganic compound comprising at least two kinds of elements selected from groups 13, 14 and 15 of the periodic table to active light so that said solid material provides said non-image region and said image region, and then, bringing print ink into contact therewith to form a printed surface in which the image region has received the print ink.

6. A method for making a lithographic printing plate according to claim 5, wherein the support comprises a support having thereon a layer formed of the solid material of said inorganic compound.

7. A method for making a lithographic printing plate, which comprises forming an image by irradiating a plate precursor for a lithographic printing plate comprising a surface formed of a solid material of an inorganic compound wherein said inorganic compound is $Si_3N_4$ with a laser beam having a wavelength of 800 to 1,200 nm so that said solid material provides said non-image region and said image region, and then, deleting the image by irradiating it with a laser beam having a wavelength of 10 to 20 $\mu$m.

8. A method for producing a plate precursor for a lithographic printing plate, which comprises forming an image by irradiating a plate precursor for a lithographic printing plate comprising a surface formed of a solid material of an inorganic compound wherein said inorganic compound is $Si_3N_4$ with a laser beam having a wavelength of 800 to 1,200 nm so that said solid material provides said non-image region and said image region, and then, after termination of printing, exposing the whole surface of the lithographic printing plate to a laser beam having a wavelength of 10 to 20 $\mu$m.

9. A method for making a lithographic printing plate, which comprises making a non-image region hydrophilic and an image region ink-receptive by imagewise exposure of a plate precursor for the lithographic printing plate comprising a surface formed of a solid material of an inorganic compound wherein said inorganic compound is $Si_3N_4$ to active light so that said solid material provides said non-image region and said image region, and then, bringing print ink into contact therewith to form a printed surface in which the image region has received the print ink.

* * * * *